United States Patent [19]

Prime

[11] 4,293,270

[45] Oct. 6, 1981

[54] EXCAVATORS

[75] Inventor: Derek A. Prime, Burton on Trent, England

[73] Assignee: J. C. Bamford Excavators Limited, Great Britain

[21] Appl. No.: 3,596

[22] Filed: Jan. 15, 1979

[30] Foreign Application Priority Data

Jan. 17, 1978 [GB] United Kingdom ..... 1745/78

[51] Int. Cl.[3] ..... E02F 3/38

[52] U.S. Cl. ..... 414/690; 414/694; 414/718; 212/231; 403/110

[58] Field of Search ..... 414/686, 690–695, 414/718, 727, 722; 403/104, 110; 52/115–120; 280/456 R; 212/144, 55, 267, 230, 231

[56] References Cited

U.S. PATENT DOCUMENTS

| | | | |
|---|---|---|---|
| 3,465,904 | 9/1969 | Pensa | 414/694 |
| 3,608,930 | 9/1971 | Saran | 414/695 X |
| 3,614,134 | 10/1971 | Saran | 280/456 R |
| 3,788,674 | 1/1974 | Casey | 414/694 X |
| 3,891,065 | 6/1975 | Iijima | 414/695 X |
| 3,923,172 | 12/1975 | Jankowiak | 414/694 X |
| 3,977,148 | 8/1976 | Ranini | 414/718 X |
| 4,015,730 | 4/1977 | Symmank | 212/231 X |

*Primary Examiner*—Leslie J. Paperner
*Assistant Examiner*—Terrance L. Siemens
*Attorney, Agent, or Firm*—Klarquist, Sparkman, Campbell, Leigh, Whinston and Dellett

[57] ABSTRACT

An excavator having a boom with slidably engaging base and beam parts is disclosed. The base part is mounted on a support part of the excavator for rotation about a horizontal axis; and a dipper arm which carries an excavating tool is pivotally suspended from the beam part. The base and beam parts are joined by channel section guides which permit sliding movement between the parts. A wedge member releasably fixes the relative position of the base and beam parts by wedgingly engaging both parts.

12 Claims, 7 Drawing Figures

EXCAVATORS

This invention relates to a mechanical excavator comprising a support part, a boom mounted on the support part for rotation about a horizontal axis, a dipper arm pivotally connected to the boom at the other end thereof, an excavating tool means carrying the excavating tool at one end of the dipper arm, fluid pressure means to cause pivotal movement of the boom relative to the support part and of the dipper arm relative to the boom, the boom comprising a base part pivotally mounted about a first axis to the support part to provide said pivotal connection of the boom and a beam part having the dipper arm pivotally connected thereto about a second axis to provide said pivotal connection of the dipper arm to the boom, bearing means to connect together the base and beam parts said bearing means comprising a pair of parallel channel section guide means, spaced apart transversely of the direction of relative movement between the boom parts, provided on one boom part and having slidably engaged therein opposed flange parts of the other boom part which permit of relative sliding movement between said parts to vary the distance between said first and second axes and clamping means comprising at least one wedge member adapted to be moved into wedging engagement between the boom parts.

BACKGROUND OF THE INVENTION

1. Field of the Invention

This invention relates to mechanical excavators of the type comprising a boom of variable length, mounted on a support part for up and down movement about a horizontal axis, a dipper arm pivotally connected to the boom at or near the outer end thereof and the dipper arm carrying at one of its ends an excavating tool there being fluid operated means to cause pivotal movement of the boom relative to the support part and of the dipper arm relative to the boom. Such an excavator will be referred to hereinafter as "of the type described".

An excavator of the type described may be mounted on a sub-frame which is mounted on a ground engaging propulsion means by a turntable assembly whereby the sub-frame and excavator mounted thereon can rotate relative to the propulsion means about a vertical axis. The sub-frame may also carry the operators cab, fluid control means and an engine for providing power for driving the machine and the ground engaging propulsion means may comprise a pair of endless tracks or alternatively may comprise a wheeled propulsion means.

Alternatively an excavator of the type described may be mounted at the rear of a tractor the support part comprising a frame mounted on the rear of the tractor or alternatively the support part may comprise an integral part of the tractor.

An object of the invention is to provide a new and improved excavator of the type described.

SUMMARY OF THE INVENTION

According to the invention we provide an excavator of the type described wherein the boom comprises a base part pivotally mounted about a first axis to the support part to provide said pivotal connection of the boom and a beam part having the dipper arm pivotally connected thereto about a second axis to provide said pivotal connection of the dipper arm to the boom, the base and beam parts being connected together by bearing means comprising a pair of parallel channel section guide means, spaced apart transversely of the direction of relative movement between the boom parts, provided on one boom part and having slidably engaged therein opposed flange parts of the other boom part which permit of relative sliding movement between said parts to vary the distance between said first and second axes and clamping means comprising at least one wedge member adapted to be moved into wedging engagement between the boom parts.

The beam part may be connected to the base part for movement relative thereto in a direction tangential to a circle centered on said first axis.

Each channel section guide means may comprise two channel section members spaced apart longitudinally of said direction of relative movement.

The guide means may be provided on the base part.

The flange parts may comprise edge portions of a base plate of a trapezoidal section beam part.

The beam part may be of welded construction comprising four plates constituting a bottom part, a parallel top part and upwardly and inwardly inclined side parts.

Preferably the or each wedge member is moved into wedging engagement between a flange part and a guide means.

Preferably two wedge members are provided mounted on the base part and connected by levers to the piston of a fluid operated ram mounted in the base part the levers extendjing in a direction which is substantially transverse to the direction of movement of the piston but inclined slightly in the direction of the piston movement so that movement of the piston causes outward movement of the wedge members in a direction transverse to the direction of piston movement into said wedging engagement.

BRIEF DESCRIPTION OF THE DRAWINGS

The invention will now be described in more detail by way of example with reference to the accompanying drawings wherein.

DESCRIPTION OF THE PREFERRED EMBODIMENT

Figure 1:
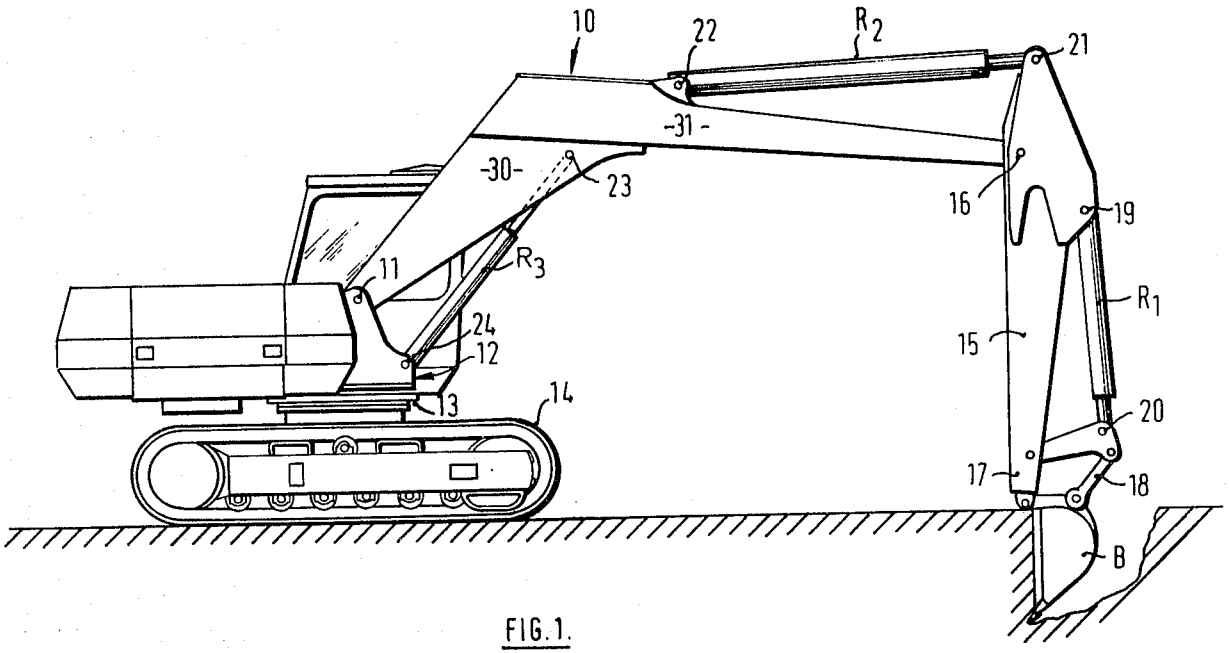
FIG. 1 is a side elevation of an excavator embodying the invention and shown mounted on an excavating machine.

Referring to the drawings an excavator comprises a boom 10 pivotally mounted at one end about a first axis 11 to a sub-frame 12 mounted, by means of a turntable assembly 13 on an endless track ground engaging propulsion means 14.

At the other end of the boom a dipper arm 15 is pivotally mounted about a second axis 16 and the dipper arm carries, at its other end 17, an excavating tool such as a bucker, B, which is adapted to be pivoted by a conventional linkage indicated at 18. A hydraulic ram $R_1$ is connected between the points 19 and 20 to cause pivotal movement of the bucket whilst a hydraulic ram $R_2$ is connected between the dipper arm 15 about the axis 21 and the boom 10 about the axis 22 to cause pivotal movement of the dipper arm relative to the boom about the axis 16. A hydraulic ram $R_3$ is connected to the boom about an axis 23 and to the sub-frame 12 about an axis 24 to cause pivotal movement of the boom about the axis 11.

Figure 2:
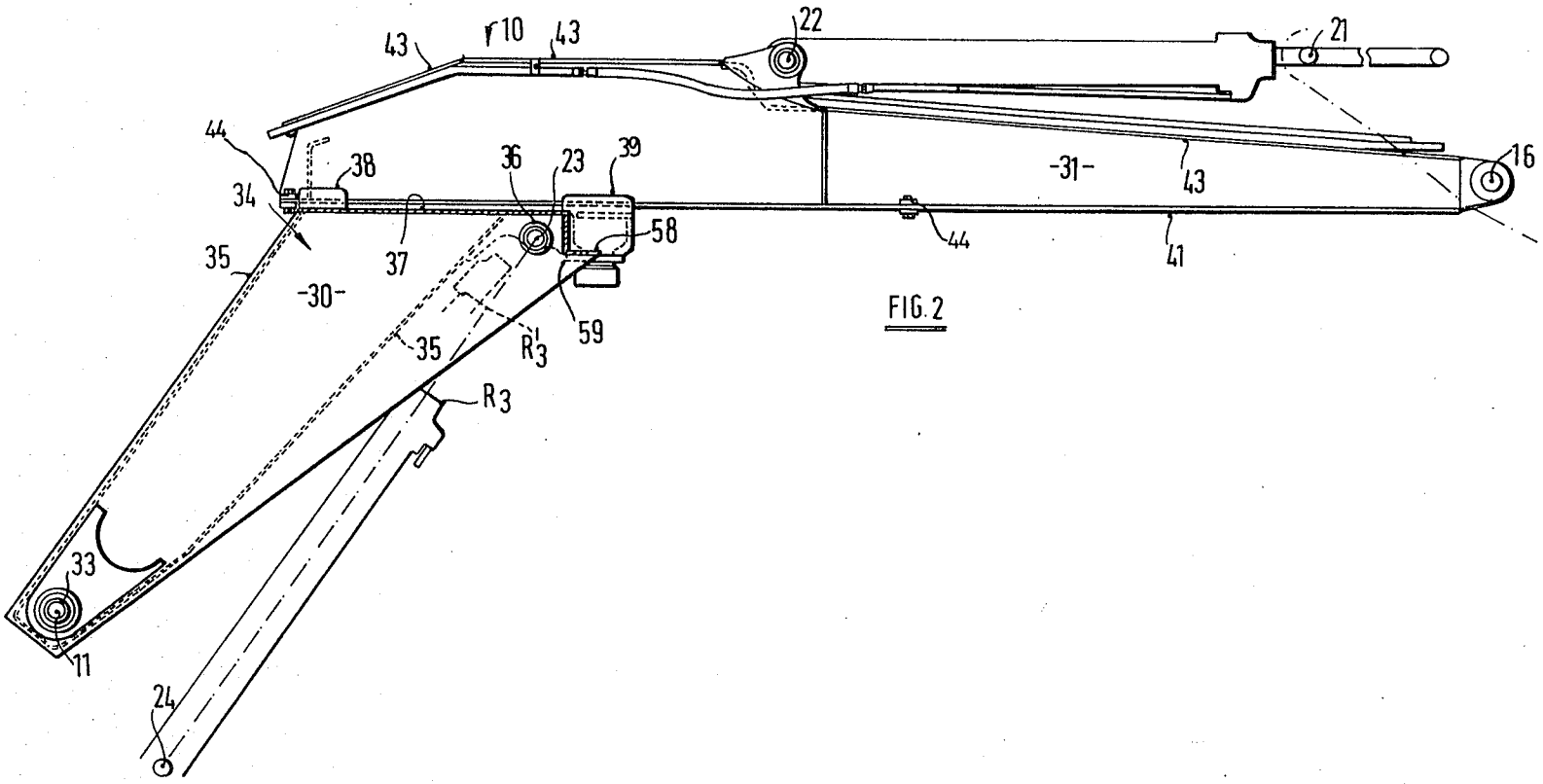
FIG. 2 is a side elevation partly in section, showing the boom of FIG. 1.
Figure 3:
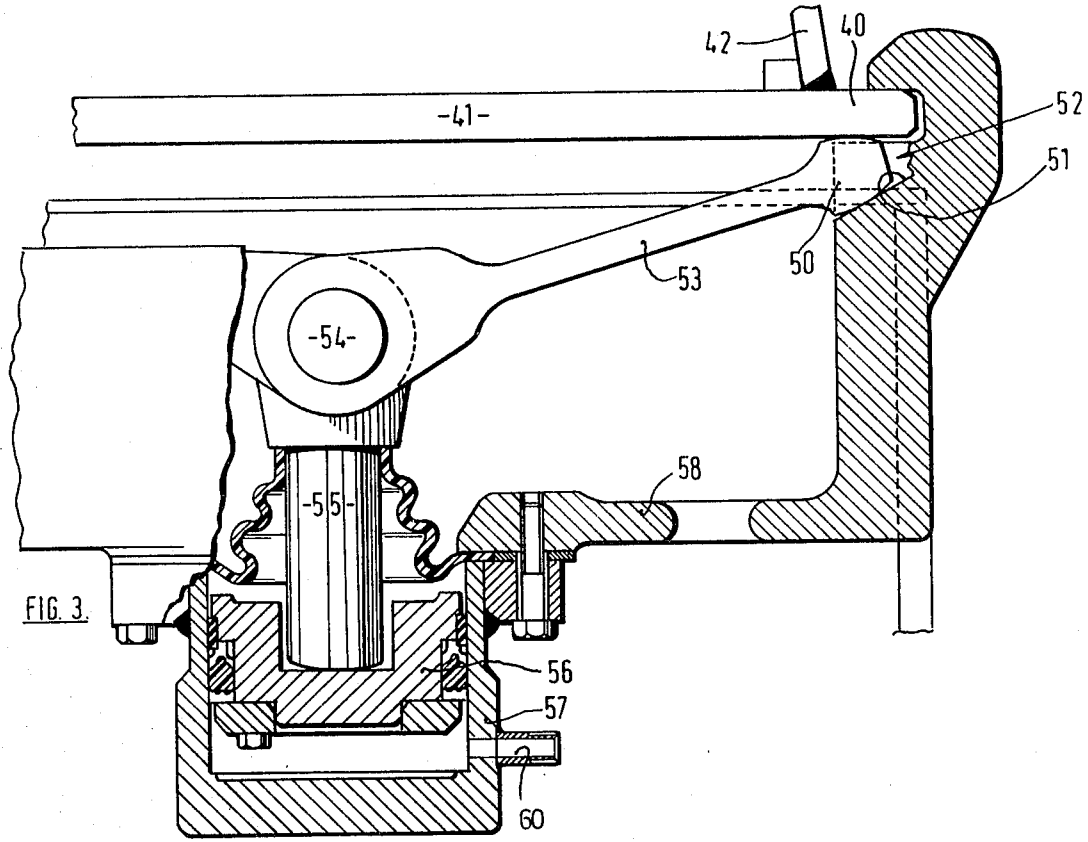
FIG. 3 is a section on the line B—B of FIG. 2 to an enlarged scale.
Figure 4:
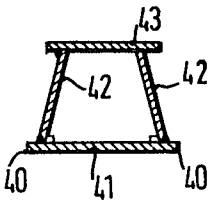
FIG. 4 is a section on the line C—C of FIG. 2

Referring now particularly to FIG. 2 the boom 10 comprises a first, base, part 30 and a second, beam, part 31.

The base part 30 is provided with a pivot pin receiving means 33 to mount the boom for pivotal movement about the axis 11 and comprises a pair of generally triangular side plates 34 connected together by end plates 35. Between the plates 34 outwardly of the front end plate 35 a boss 36 is provided to receive a pivot pin for mounting the boom ram for movement about the axis 23 and the space between the plates 30 accommodates the end of the ram which is movable from the solid line position indicated at $R_3$ to the dotted line position indicated at $R_3$ in FIG. 2.

At its upper end the base part 30 has a top plate 37 which lies in a horizontal plane when a line joining the mid-point of the plate 37 to the axis 11 lies at an angle of 49° to the horizontal.

Figure 6:
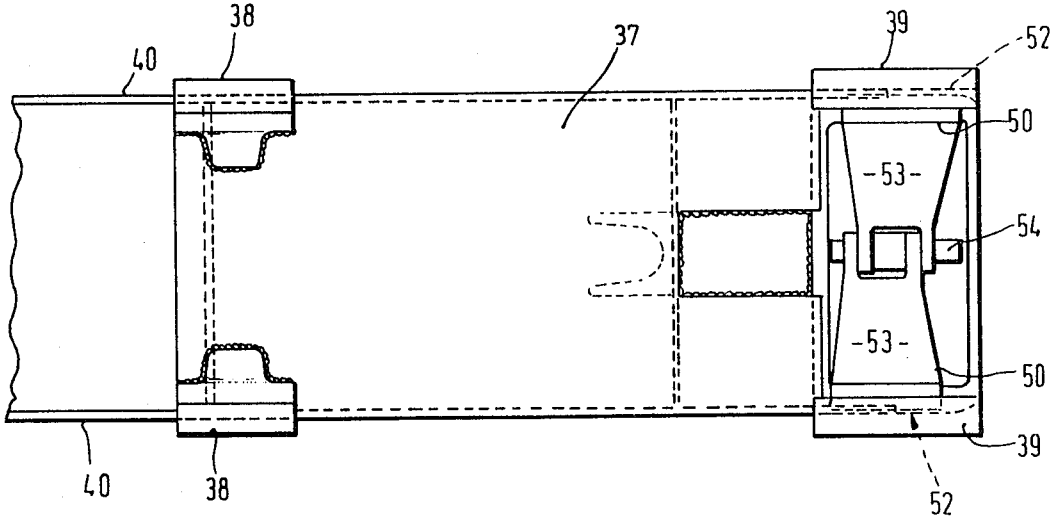
FIG. 6 is a fragmentary plan view of the base part of the boom of FIG. 2.
Figure 7:
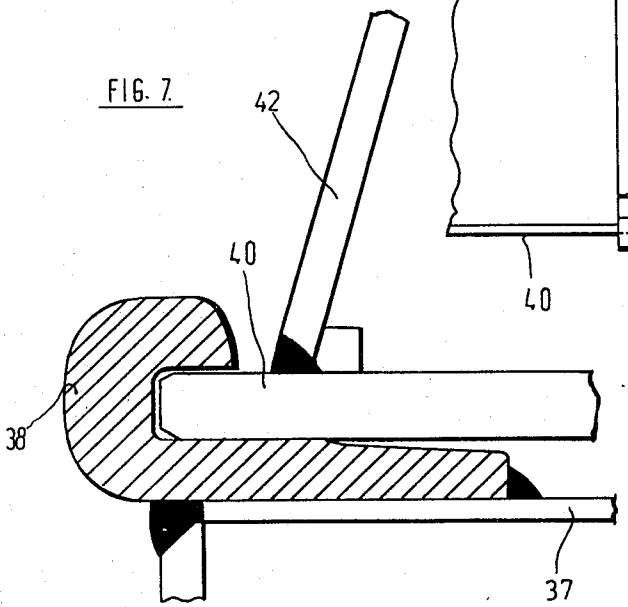
FIG. 7 is a fragmentary cross sectional view through a guide means.

As best shown in FIGS. 6 and 7 the base part 30 is provided with a pair of transversely spaced guide means. Each guide means comprises a generally channel section guide member 38 at one end of the plate 37 and a further generally channel section guide means 39 at the other end of the plate 37.

Figure 5:
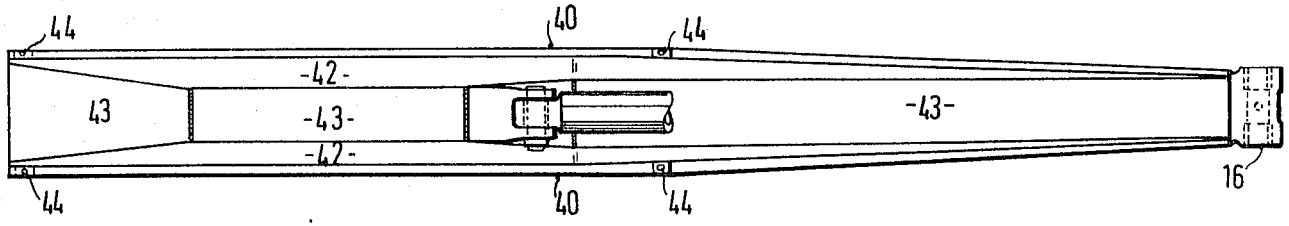
FIG. 5 is a plan view of a beam part of the boom of FIG. 2.

Slidably received within the guide members 38 and 39 are flange parts 40 which extend outwardly on opposite sides of the beam part 31 and are provided by edge portions of a bottom plate 41 which is connected by upwardly and inwardly inclined side plates 42 to a top plate 43. The top plate 43 is in fact made up of 3 separate plates as best shown in FIGS. 2 and 5 in accordance with the shape of the side plates 42. Blocks 44 are secured to the flange parts 40 to limit the sliding movement of the beam part 31 relative to the base part 30 and to the right, in FIGS. 2 and 5, of the blocks 44 adjacent the mid part of the beam part 31 the flange parts 40 are tapered as shown in FIG. 5 whilst between the blocks 44 flange parts 40 are parallel to each other. The trapezoidal section of the beam part provides both the flange part 40, for mounting the beam part on the base part 30 and for clamping purposes as hereinafter described, and also an ideal structural section to withdtand the applied loads.

As a result of the engagement of the flange parts 40 with the guide means 38 and 39 and the clamping means hereinafter described the beam part 31 is permitted to slide relatively to the base part 30 so as to vary the distance between the axes 11 and 16 and thus to adjust, in an infinitely variable manner, the radius of the axis of pivot 16 relative to the axis of rotation of the turntable assembly 13.

In order to clamp the beam part relative to the base part a pair of wedge members 50 are provided to act between the underside of the flange part 40 and upwardly facing inclined surface 51 of a pocket 52 are provided in the guide means 39. The wedge members 50 are connected by levers 53 to a cross head 54 of a piston rod 55 connected to a hydraulic piston 56 slidably mounted in a cylinder 57 bolted to the underside of a plate 58 provided in a recessed part 59 of the side plates 34 of the base part 30. A coupling means 60 is provided to permit hydraulic fluid to be supplied to the interior of the cylinder 57 to act on the piston 56 to cause upward movement of the piston rod 55 and thus generally outward movement of the levers 53 and hence of the wedge members 50 into wedging engagement between the undersurface of the flange part 40 and the surface 51.

In order to permit adjustment of the parts of the boom relative to one another, fluid is exhausted from the cylinder 57 to release the wedging members 50 from wedging engagement with the boom parts and the excavating tool on the dipper arm is engaged with the ground, preferably with the dipper arm 15 in a vertical position as shown in FIG. 1 so that the top plate 37 of the base part 30 will be approximately horizontal and the ground propulsion means is then operated to move the boom part 30 in the desired direction relative to the beam part 31 until the parts are in their desired position and then fluid is again fed to the cylinder 57 to move the wedge members 50 into wedging engagement with the parts.

I claim:

1. A mechanical excavator comprising a support part and a boom, said boom comprising a base part and a beam part, means pivotally to connect said base part to said support part, means to pivot said base part about a horizontal axis, a dipper arm, means to pivot said dipper arm on said beam part about a second horizontal axis, an excavating tool and means carrying said excavating tool on one end of the dipper arm, bearing means to connect together said base part and said beam part for relative movement in a first direction, said bearing means comprises a pair of parallel channel section guide means, spaced apart transversely of the direction of relative movement between the boom parts, provided on one boom part, opposed flange parts provided on the other boom part and slidably engaged in said guide means to permit relative sliding movement between said parts to vary the distance between said first and second horizontal axes and clamping means comprising at least one wedge member, and means to move said wedge member into wedging engagement with said boom parts in a direction transverse to the direction in which the resultant forces between the wedge member and boom parts act.

2. An excavator according to claim 1 wherein the beam part is connected to the base part for movement relative thereto in a direction tangential to a circle centered on said first axis.

3. An excavator according to claim 1 wherein each channel section guide means comprises two channel section members spaced apart longitudinally of said direction of relative movement.

4. An excavator according to claim 1 wherein the guide means is provided on the base part.

5. An excavator according to claim 4 wherein the flange parts comprise edge portions of a base plate of a trapezoidal section beam part.

6. An excavator according to claim 5 wherein the beam part is of welded construction comprising four plates providing a bottom part, a top part parallel to the bottom part and upwardly and inwardly inclined side parts.

7. An excavator according to claim 1 wherein the base part is of welded construction comprising plates providing a top part lying in a plane tangential to a circle centered on said first axis and normal thereto a pair of parallel downward depending side parts, the beam part being supported on said top part in said bearing means.

8. An excavator according to claim 1 wherein the excavator is mounted on a ground engaging propulsion means by a turntable assembly whereby the sub-frame and excavator mounted thereon can rotate relative to the propulsion means about a vertical axis.

9. An excavator according to claim 1 wherein said means to move said wedge member comprises a fluid operated piston connected to the member.

10. An excavator according to claim 1 or claim 9 wherein the wedge member is moved into wedging engagement between a flange and the one boom part.

11. An excavator according to claim 10 wherein the surfaces of the flange part and the one boom part which are engaged by the wedge member are inclined to provide a narrowing space in the second direction.

12. An excavator according to claim 1 having a fluid operated ram, means to mount said fluid operated ram in said base part, said ram having a piston movable along an operating axis, the piston having connected thereto one end of each of two levers, each lever having connected at another end thereof a wedge member, said levers extending generally transversely of said operating axis and being inclined at an angle relative to one another to form a substantially V-shaped structure, said structure having an apex lying on the operating axis of the fluid operated ram whereby movement of the piston along said operating axis increases the angle between the levers which results in outward movement of the wedge members into wedging engagement with the boom parts.

* * * * *